US009372497B2

(12) United States Patent
Wall et al.

(10) Patent No.: US 9,372,497 B2
(45) Date of Patent: Jun. 21, 2016

(54) ROTARY ACTUATOR

(75) Inventors: Christian Wall, Hitzhofen (DE); Sten Währisch, Dresden (DE)

(73) Assignee: AUDI AG, Ingolstadt (DE)

( * ) Notice: Subject to any disclaimer, the term of this patent is extended or adjusted under 35 U.S.C. 154(b) by 232 days.

(21) Appl. No.: 13/578,151

(22) PCT Filed: Dec. 23, 2010

(86) PCT No.: PCT/EP2010/007936
§ 371 (c)(1),
(2), (4) Date: Aug. 9, 2012

(87) PCT Pub. No.: WO2011/098114
PCT Pub. Date: Aug. 18, 2011

(65) Prior Publication Data

US 2012/0304802 A1 Dec. 6, 2012

(30) Foreign Application Priority Data

Feb. 13, 2010 (DE) ..... 10 2010 007 913

(51) Int. Cl.
*G05G 1/08* (2006.01)
*G05G 5/03* (2008.04)
*G05G 5/06* (2006.01)

(52) U.S. Cl.
CPC .. *G05G 1/08* (2013.01); *G05G 5/03* (2013.01); *G05G 5/06* (2013.01); *Y10T 74/20636* (2015.01)

(58) Field of Classification Search
CPC ..... G05G 5/03; G05G 5/065; G05G 1/08; G05G 1/10; G05G 1/12; G05G 1/105; G05G 5/06; Y10T 74/20636; Y10T 74/2084; Y10T 74/20654; Y10T 74/2066; H01H 3/08; H01H 3/10
USPC ..... 74/527, 553, 504, 10 R, 10.22, 10.29, 74/10.1, 10.15, 10.41, 10.6; 345/184; 200/318, 336
See application file for complete search history.

(56) References Cited

U.S. PATENT DOCUMENTS 2,153,430 A 4/1939 Newman
2,155,594 A * 4/1939 Hart ..... 74/527
(Continued)

FOREIGN PATENT DOCUMENTS

CN 2738373 11/2005
CN 2762317 3/2006
(Continued)

OTHER PUBLICATIONS

DE 19737392 A1—Machine Translation.*
(Continued)

*Primary Examiner* — Daniel Yabut
(74) *Attorney, Agent, or Firm* — Staas & Halsey LLP

(57) ABSTRACT

A rotary actuator has a first rotatable part having a control surface with an undulating or sawtooth profile, and has a fixed second part having at least one detent element running on the control surface. The detent element is accommodated, in a manner which allows movement against a restoring force, in an aperture which tapers in a V shape towards the first part. The detent element is accommodated with play between the side walls bounding the aperture. The detent element interacts with the radially oriented control surface in such a way that, as it runs up a projection on the control surface as a result of a movement of the first part, it is moved against one side wall and, upon passing beyond the projection, strikes against the other side wall due the restoring force.

10 Claims, 3 Drawing Sheets

(56) References Cited

U.S. PATENT DOCUMENTS

| | | | | | |
|---|---|---|---|---|---|
| 2,558,276 | A * | 6/1951 | Simpson | G01R 15/08 116/280 |
| 2,857,782 | A * | 10/1958 | Glueckstein et al. | 74/527 |
| 2,966,807 | A * | 1/1961 | Garver et al. | 74/504 |
| 3,008,344 | A * | 11/1961 | Dracka | 74/527 |
| 3,293,382 | A * | 12/1966 | Lewandowski et al. | 200/14 |
| 3,564,929 | A * | 2/1971 | Halstead | 74/10.2 |
| 3,672,419 | A * | 6/1972 | Fischer | 81/460 |
| 3,679,846 | A * | 7/1972 | Dillon et al. | 200/6 A |
| 3,768,333 | A * | 10/1973 | Bidwell | 74/527 |
| 3,786,693 | A * | 1/1974 | Keipert | 74/527 |
| 4,012,966 | A * | 3/1977 | Lieberman et al. | 74/553 |
| 4,069,723 | A * | 1/1978 | Payerle | G05G 5/06 384/584 |
| 4,298,922 | A * | 11/1981 | Hardwick | 362/376 |
| 4,337,850 | A * | 7/1982 | Shimokura | 188/282.9 |
| 4,429,196 | A * | 1/1984 | Beig et al. | 200/61.54 |
| 4,491,703 | A * | 1/1985 | Jaklic | 200/16 D |
| 5,220,152 | A * | 6/1993 | Doran | 219/201 |
| 5,862,715 | A * | 1/1999 | Lemire | 74/553 |
| 6,085,612 | A * | 7/2000 | Thorn et al. | 74/531 |
| 2002/0080114 | A1* | 6/2002 | Numata et al. | 345/156 |
| 2006/0108127 | A1* | 5/2006 | Batthala et al. | 172/2 |
| 2008/0041185 | A1* | 2/2008 | Hanna | B60T 7/045 74/512 |
| 2008/0197004 | A1* | 8/2008 | Ishigaki et al. | 200/336 |
| 2008/0251363 | A1* | 10/2008 | Onodera | 200/336 |
| 2010/0319479 | A1* | 12/2010 | Sjolin et al. | 74/504 |

FOREIGN PATENT DOCUMENTS

| | | | |
|---|---|---|---|
| DE | 197 37 392 | | 3/1998 |
| DE | 10 2006 026 610 | | 2/2007 |
| DE | 10 2006 036 636 | | 2/2007 |
| DE | 10 2008 007 214 | | 8/2008 |
| DE | 10 2007 038 547 | | 2/2009 |
| EP | 1 795 990 | | 6/2007 |
| FR | 596.655 | | 10/1925 |
| GB | 1240651 | A * | 7/1971 |
| WO | WO 02/093604 | | 11/2002 |

OTHER PUBLICATIONS

EPO Translation of Description of DE 19737392, Ogawa et al., Mar. 5, 1998.*

International Preliminary Report on Patentability for PCT/EP2010/007936.

International Search Report of Corresponding PCT Application PCT/EP2010/007936 mailed Jun. 24, 2011.

German Search Report of Corresponding Application 102010007913.8 dated Sep. 28, 2010.

Chinese Office Action issued Nov. 18, 2013 in Chinese Patent Application No. 201080063761.1.

Chinese Office Action issued May 19, 2014 in Chinese Patent Application No. 201080063761.1.

* cited by examiner

ROTARY ACTUATOR

CROSS-REFERENCE TO RELATED APPLICATIONS

This application is a U.S. National Phase application of PCT/EP2010/007936 filed Dec. 23, 2010 and claims the priority benefit of German Application No. 102010007913.8 filed Feb. 13, 2010 in the German Intellectual Property Office, the contents of both of which are incorporated herein by reference.

BACKGROUND

The invention relates to a rotary actuator comprising a first rotatable part, having a control surface with an undulating or sawtooth profile, and a fixed second part, having at least one detent element running on the control surface.

Rotary actuators of this kind are used in motor vehicles, for example, and are used to control different functions, which are indicated on a display, for example. They can be used to control different systems in the motor vehicle, such as a navigation system, an integrated telephone, an infotainment system and the like, and also to control or choose individual functions within the systems. A rotary actuator of this kind often also has a selecting function, being capable of axial actuation to select a desired function, thus having an axial switching function. However, the use of a latched rotary actuator of this kind is not restricted exclusively to the motor vehicle sector; on the contrary, a latched incremental rotary actuator of this kind can, of course, also be employed on any other equipment.

In order to provide the large number of functions and settings of many different kinds by the rotary actuator in a way which is recognizable for the user, it is necessary to provide unambiguous feedback in the form of haptic and acoustic feedback by the movement of the rotary actuator alone, thus ensuring that, as the rotary actuator is moved, the user "experiences" each individual movement from one latched position into the next both haptically and acoustically. For this purpose, the rotary actuator has a first rotatable part, which the user actively moves, which has a control surface with an undulating or sawtooth profile. This surface interacts with a detent element running on the control surface, which is provided on a fixed second part, relative to which the first part is moved. On known rotary actuators, the detent element is generally designed as a leaf spring component with a detent nose facing the control surface, the usual practice being to provide two detent elements of this kind, generally arranged offset by 180°, which are either fixed without play or mounted with a slight play. As the rotatable part is turned, the detent nose of the detent element runs up the control surface and is moved out of the detent receptacle by the control surface projection. As it is turned further, the detent nose reaches the tooth head of the control surface. If it is turned further once again, the detent nose of the spring fixed without play slides down the opposite tooth flank and enters the detent receptacle without the occurrence of a jump. However, if the detent nose of a spring subject to play reaches the tooth head and passes beyond it, it is displaced abruptly into the detent receptacle of the control surface and strikes against the opposite stop or opposite tooth flank, and there is a clicking noise. In the case of detent elements fixed without play, however, the clicking noise, in particular the intensity thereof, is dependent on the speed of operation. If the user turns the first part very slowly, there is as it were a "damped" slow sliding motion of the detent element into the latched position and consequently a slight clicking noise, in contrast with a rapid rotation, in which case the detent nose snaps very quickly and heavily into the detent receptacle. In the case of detent elements of this kind, which are guided without play, the acoustic behavior is therefore not constant irrespective of the rotation of the first part. On the other hand, a very slight rotational play in the notch is achieved. When the detent elements are mounted in a manner subject to play, acoustics independent of the speed of operation and hence more constant acoustic behavior are produced, but the rotational play in the notch increases, thereby impairing the haptic properties. This is because the snap action, in particular, contributes to the haptics and, as described, the snap action is ultimately dependent on the speed of operation. That is to say that both the haptics and the acoustics vary depending on the mounting of the detent elements and the speed of operation and that therefore a constant level of convenience of operation and uniform feedback to the user are not achieved.

SUMMARY

One potential goal is therefore to achieve an improvement in the haptic and acoustic behavior of a rotary actuator of the type stated at the outset.

To solve this problem, the inventors propose a rotary actuator, in accordance with a first alternative, for the detent element to be accommodated, in a manner which allows movement against a restoring force, in an aperture which tapers in a V shape towards the first part, the detent element being accommodated with play between the side walls bounding the aperture, wherein the detent element interacts with the radially oriented control surface in such a way that, as it runs up a projection on the control surface as a result of the movement of the first part, it is moved against one side wall and, upon passing beyond the projection, strikes against the other side wall owing to the restoring force.

In the proposed rotary actuator, it is possible, on the one hand, for the detent element to be moved in the aperture relative to the control surface against a restoring force, i.e. it can be moved into the aperture over a control surface tooth against the restoring force. On the other hand, the detent element is also accommodated with lateral play in the aperture. The aperture itself is bounded by two side walls, which taper in a V shape towards one another, i.e. the aperture tapers in the direction of the control surface. The detent element, e.g. a ball or a roller, can therefore move between the two side walls. The aperture is situated directly adjacent to the control surface, i.e. the side walls bounding the aperture end as close as possible to the control surface.

When the first part is turned in operation, the detent element, which was previously accommodated in the detent receptacle, preferably positively, runs up the tooth flank of the next control surface tooth in the direction of rotation and, at the same time, is pressed against one oblique side wall and, owing to the fact that it runs up the control surface tooth along this lateral surface, is pressed into the aperture. When the uppermost point of the tooth head is passed, the detent element is as it were released and, owing to the restoring force, which urges it continuously against the control surface, it snaps against the opposite side wall more or less counter to the direction of rotation since the control surface tooth has been moved onwards relative to the aperture to such an extent that the subsequent detent aperture is already in the region below the aperture. There is therefore an abrupt change in contact from one side wall to the opposite side wall. This snap or bump action then produces a characteristic noise, which is perceived by the user and indicates to the latter that he has reached the next detent aperture.

In the rotary actuator, the V shaped aperture thus produces an acoustic noise which is independent of the manner of operation since the snap action, i.e. the noise-producing change in contact from one side wall to the opposite side wall is ultimately dependent only on position, i.e. on the specific position of the respective control surface tooth which moves the detent element, not on the speed of operation. Equally independent of the speed of operation is the haptic behavior too, since the user receives direct feedback as to when the change in contact occurs, i.e. when the snapover occurs. Whereas the intensity of noise generation can be adjusted by the mass of the detent element, the material thereof, the restoring force applied and the flank angle of the V-shaped side walls of the aperture, the haptics can be adjusted by the shape of the control surface and of the detent element. In the case of the rotary actuator too, only one such detent element is required, even if it is, of course, also possible to provide two such detent elements, for example.

As described, the detent element itself can be a ball or a roller. It is therefore a component of simple geometry which does not require any special production method and has low manufacturing tolerances, thereby making it possible to reduce the scatter in the haptic behavior, i.e. to ensure that all the rotary actuators have more or less the same haptic behavior.

A spring element, in particular a helical or leaf spring, is expediently provided to produce the restoring force, urging the detent element continuously against the control surface. However, the spring element itself is mounted in such a way or has a bearing surface for the detent element such that the detent element can snap over from one side wall to the other in the manner.

According to the inventors', a second alternative solution in the case of a rotary actuator of the type stated at the outset envisages that the detent element is fixed in position and interacts with an axially oriented control surface of the first part, which can be moved axially against a restoring force, wherein the first part engages with radial play in a recess by an axially aligned peg, wherein the peg has a frustoconical shape and the recess has a shape substantially complementary to the latter, with the result that, as the peg runs up a projection of the control surface as a result of a movement of the first part, the peg is raised while resting against the wall surface of the recess and, upon passing the projection, snaps back owing to the restoring force and strikes against the opposite wall surface.

While the above-described first alternative describes a rotary actuator construction having a radially oriented control surface, the second solution specifies a rotary actuator construction having an axially oriented control surface. In this embodiment, the detent element is fixed in position, i.e. it is itself not moved, unlike in the first embodiment. On the contrary, the first part is moved by the axially oriented control surface, which can both be rotated about the pivot and moved axially against a restoring force. This is the case when a control surface tooth runs up the detent element. The first part is arranged on a pin-shaped rotary part, which forms the pivot, in such a way that it can be moved axially against the restoring force. When the rotary part is rotated, it is taken along and is thus moved relative to the fixed detent element. For this purpose, the first part engages by a peg in a recess on the rotary part, the peg being accommodated with radial play in the recess, that is to say it can be moved laterally somewhat, there being, of course, also axial mobility, in order to enable the first part to be raised and lowered. Once again, the characteristic feature of this embodiment is the shaping in the region of the recess and of the peg itself. The peg has a frustoconical shape and the recess has a shape complementary to the latter.

During operation, the control surface tooth runs up the detent element when there is a rotation of the first part brought about by rotation of the rotary part, starting from engagement of the detent element in a detent receptacle of the control surface, which engagement is preferably positive in this case too. Since the detent element is fixed, the first part is consequently raised and simultaneously rotated and is therefore moved axially along the pin-shaped rotary part against the restoring force. During this process, the bearing journal is necessarily also raised in the bearing recess and, during this raising motion, it rests against the wall surface of the bearing recess owing to the radial play. If the control surface tooth head then passes beyond the detent element, the first part is as it were "released" here. There is a more or less abrupt snapping in of the first part or of the detent recess of the control surface thereof on the detent element since the restoring force that has been built up urges it into this positive latched position. Associated with this is an abrupt change in the contact of the peg with the wall surface of the recess, that is to say that the peg snaps from one wall side to the opposite wall side and strikes against the latter. There is a surface-to-surface impact since the respective surface gradients are substantially the same.

In this embodiment too, there is defined noise generation since the peg always strikes against the wall of the recess owing to the snapping in of the detent recess of the control surface on the detent element, that is to say owing to the jump in the angle of rotation produced by the restoring force. An unambiguous haptic feedback is also given by virtue of this jump in the angle of rotation owing to the restoring force after the tooth head has been passed. The level of excitation can be adjusted by the mass of the detent disk, the material thereof and the flank angle of the surfaces striking against one another.

Here too, the detent element is a ball or a roller retained at a receptacle provided on the second part, for example, that is to say it is once again an easily produced component of simple geometry, although, if required, it is, of course, also possible for the second part itself to have a corresponding arched projection which forms the detent element, eliminating the need to install a separate detent element component.

To produce the restoring force, it is expedient to provide a spring element in this case too, in particular a helical spring or leaf spring through which a pivot of the first part passes. Since, as described, the first part in this embodiment is moved axially against a restoring force, a symmetrical construction is expedient since use is preferably made of a helical spring through which a pivot-forming peg of the first part passes.

In both embodiments, it is fundamentally expedient if the detent element engages positively in a detent receptacle of the control surface. It is thereby possible to minimize the rotational play in the latched position to particular advantage.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
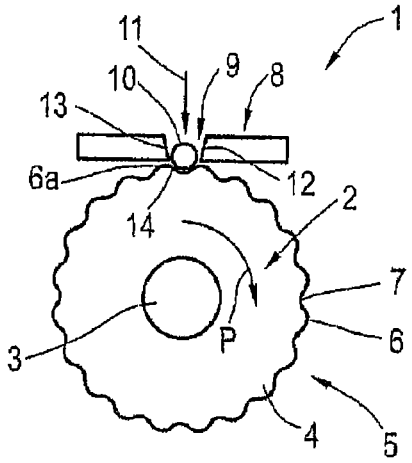
FIG. 1 shows a plan view of a rotary actuator proposed by the inventors, according to a first alternative.

Reference will now be made in detail to the preferred embodiments of the present invention, examples of which are illustrated in the accompanying drawings, wherein like reference numerals refer to like elements throughout.

FIG. 1 shows a schematic plan view of a proposed rotary actuator 1, comprising a first rotatable part 2 having a central pin- or peg-like rotary part 3, which as it were forms the pivot, and a cam disk 4 arranged thereon and having a radial control surface 5, which in this case has an undulating profile and therefore has alternate teeth 6 and detent recesses 7. The first part 2 can be rotated about the central pivot, and a corresponding handle (not shown) is attached thereto, being gripped by the user in order to twist the first part 2.

Assigned to the first part 2 is a fixed second part 8, which has an aperture 9, in which a detent element 10, in this case a ball, is accommodated against a restoring force 11 (indicated by the arrow) provided by a spring element (not shown specifically). The detent element 10 can move within the aperture 9, i.e. can be pushed deeper into the aperture, and is urged continuously in the direction of the radially oriented control surface 5 by the restoring force 11.

The aperture 9 is bounded laterally by two side walls 12, 13, which taper towards one another in the direction of the control surface 5, with the result therefore that the side wall spacing tapers towards the control surface 5. Thus, the aperture has a V shape. The detent element 10 can be moved sideways within the aperture, i.e. is accommodated with play between the side walls 12, 13.

In the initial position (FIG. 1), the detent element 10 is preferably in positive engagement with a detent recess 7, which is positioned directly below the aperture 9. The aperture 9 opens very close to the cam disk 4, and the detent element 10 protrudes from the aperture in the direction of the cam disk 4.

If, starting from the starting position shown in FIG. 1, the first part 2 is then turned as indicated by arrow P, the tooth 6*a* is turned into the region of the aperture 9. The detent element 10 now runs up the tooth flank 14 thereof and, owing to the direction of rotation, it is guided against the side wall 12 and at the same time also pushed into the aperture 9 along side wall 12, as FIG. 2 clearly shows. If the first part 2 is then turned further, starting from FIG. 2, the detent element 10 runs further up the tooth 6*a*, until it reaches the tooth head 15, i.e. the uppermost point of the tooth 6*a*. At this moment, the detent element 10 is in the position in which it is pushed furthest into the aperture 9. A minimal further rotation of the first part 2 then leads to the detent element 10 passing beyond the tooth head 15. Adjoining the tooth head 15 is the opposite, falling tooth flank 16. Owing to the restoring force 11 available, there is an abrupt snap action in the form of a jump by the detent element 10 immediately after it passes beyond the tooth head, the detent element snapping out of contact with side wall 12 into contact with side wall 13, as FIG. 3 shows. By this abrupt change in contact, the detent element 10 consequently strikes powerfully against side wall 13, and a characteristic clicking noise is produced by this bump action as acoustic information indicating that a change in the detent has occurred.

As FIG. 3 shows, the detent element 10 is still not completely in the next detent recess 7*a* in this position, but it runs into the recess upon further rotation. Owing to the abrupt change in contact combined with entry into the detent recess, the user furthermore also experiences a haptic feedback due to the change in the detent which occurs. The positive engagement in the respective detent recess 7 furthermore minimizes the rotational play in the notch. The intensity of the clicking noise can be adjusted by the mass of the detent element 10 subject to play, the material thereof, the restoring force and the flank angle of the side walls 12, 13.

In the case of rotations in the opposite direction, the same process takes place, except that the detent element 10 is moved and raised against side wall 13 by the respective tooth up which it runs, and, when it passes beyond the tooth head, it then snaps against side wall 12.

Figure 4:
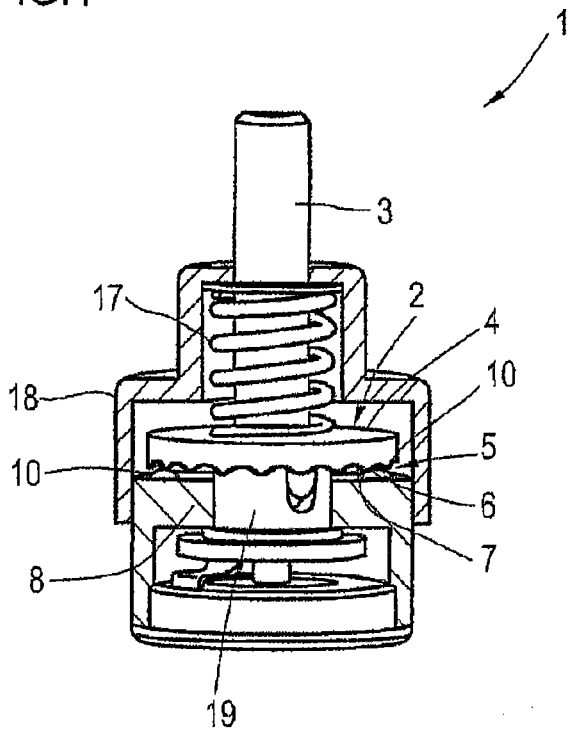
FIG. 4 shows a partially sectioned view of a rotary actuator proposed by the inventors. according to the invention a second alternative.

FIG. 4 shows a partially sectioned view through a proposed rotary actuator 1 in a second embodiment, wherein the same reference signs are used for the same components as far as possible. A pin- or peg-like rotary part 3, which forms the pivot, and a cam disk 4, which forms the first part 2 and on which a control surface 5 (in this case oriented axially) comprising teeth 6 and detent recesses 7 is formed, are provided. The first part 2, i.e. the cam disk 4, can move axially on the rotary part 3 but it is always urged downwards in the direction of the second part 8 from the position illustrated in FIG. 4 by the spring element 17, and the control surface 5 is thus spring-loaded against the two detent elements 10 provided in this case. The structure is encapsulated by a housing 18.

Figure 2:
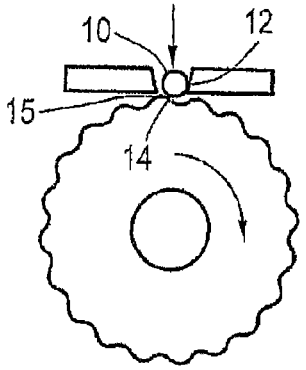
FIG. 2 shows the view of the rotary actuator in FIG. 1 with the first part twisted by a first angle.
Figure 3:
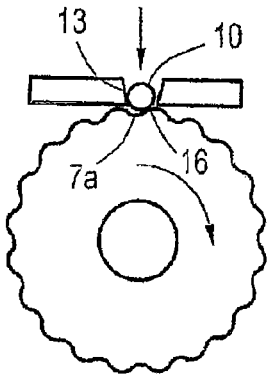
FIG. 3 shows the rotary actuator in FIG. 2 with the first part twisted further.

A detent element 10, in this case once again a ball, is accommodated in a fixed position on the second part 8 in a recess (not shown specifically here), that is to say that—unlike the embodiment shown in FIGS. 1-3—the ball does not move, it being the first part 2 which is moved in this rotary actuator 1. In this embodiment shown in FIG. 4, three detent elements 10 are provided, being offset by 120°.

A shoulder 19 of larger diameter, which provides rotary support, is provided on the rotary part 3. The rotary part 3 is thus rotatably mounted. To enable the cam disk 4 that can move axially on the latter to be taken along during rotation, a peg 20 is formed on the underside of the cam disk 4, engaging in a recess 21 on the shoulder 19. A kind of dog clutch is thereby formed. The peg 20 has a frustoconical shape. The recess 21 has a shape complementary thereto. The peg 20 is accommodated with lateral play in the recess 21 and can therefore be moved to the side in the latter, resulting in a slight capacity for rotary motion by the first part 2, i.e. the cam disk 4, about the rotary part 3.

Figure 5:
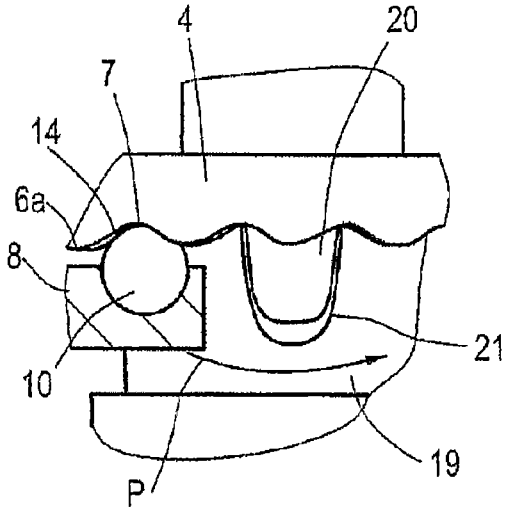
FIG. 5 shows a partial side view of the rotary actuator in FIG. 4 with the detent element in the latched position.
Figure 6:
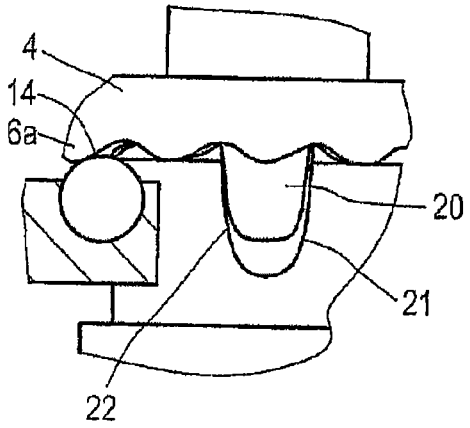
FIG. 6 shows the view as per FIG. 5 with the first part twisted by a first angle.
Figure 7:
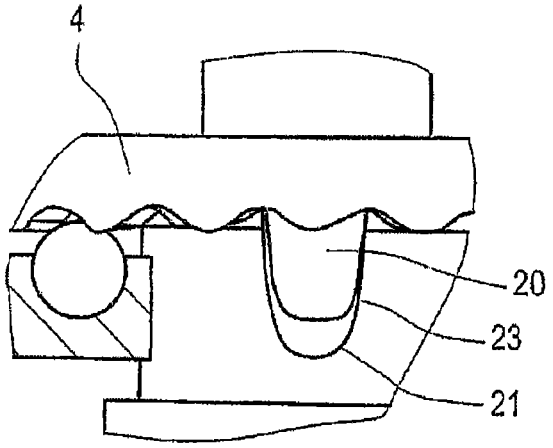
FIG. 7 shows the view in FIG. 6 with the first part twisted further.

The mode of operation of this rotary actuator 1 can be seen from FIGS. 5-7. The direction of viewing here is always towards the region of engagement of the peg 20 in the recess 21 and therefore changes with rotation, for which reason the illustrations vary slightly. FIG. 5 shows the starting position, in which the detent elements 10, of which only one is shown in each case in FIGS. 5-7, is latched positively in the respective detent recess 7 of the control surface 5. If, starting from this starting position, the rotary part 3 and consequently, together with it, the shoulder 19 are then twisted, as illustrated by the arrow P, the peg 20 is necessarily taken along in the direction of rotation by the recess 21. During this process, tooth flank 14 of the following tooth 6*a* in the direction of rotation runs up the detent element 10. This leads (see FIG. 6) to the cam disk 4 being raised counter to the spring element 17. During this process (see FIG. 6), the peg 20 is also raised in the recess 21 and is in contact with side wall 22 of the recess 21 since it is taken along by the latter.

As rotation continues, the tooth flank 14 runs further and further up the fixed detent element 10, until the tooth head, i.e. the tooth tip, rests on the detent element 10. An incremental onward motion then leads to an abrupt jump in the angle of rotation of the cam disk 4, which can move by a certain amount in the direction of rotation owing to the accommodation with play of the peg 20 in the recess 23. During this abrupt snap motion, there is a change in the contact of the peg 20 in the recess 21. It jumps from one wall side 22 of the recess to the opposite wall side 23. Due to the surface-to-surface impact with this wall surface 23, a clicking noise is produced. Depending on how great the mobility is, the cam disk 4 jumps at least partially into the next detent recess 7.

Here too, therefore, the noise is produced by the free mobility of the noise-producing elements. Whereas, in the first alternative, this was the detent element 10, which can move in the aperture 8, in the second alternative it is the peg 20, which can move in the recess 21, or the movable control cam 4. In the second embodiment too, an unambiguous haptic response can be experienced by the user since the action of snapping over the tooth head is associated with a haptically discernible change in the mobility of the rotary actuator 1.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide v. DIRECTV*, 69 USPQ2d 1865 (Fed. Cir. 2004).

The invention claimed is:

1. A rotary actuator comprising:

a rotatable first part, comprising an axially aligned peg having a frustoconical shape, and an axially oriented control surface with projections forming an undulating or sawtooth profile, the first part being movable axially against a restoring force; and a fixed second part, comprising at least one detent element running on the control surface, wherein the detent element is fixed in position and interacts with the control surface of the first part, wherein the peg engages with circumferential play when fully engaged in a recess having a first wall surface and a second wall surface and a shape complementary to the peg, and as the detent element runs up a projection, of the projections, of the control surface as a result of a movement of the first part, the peg is partially disengaged from the recess in an axial direction while partially resting against the first wall surface of the recess and, upon passing beyond the projection, the peg snaps back due to the restoring force and strikes against the second wall surface.

2. The rotary actuator according to claim 1, wherein the detent element is a ball or a roller held in a receptacle provided on the second part.

3. The rotary actuator according to claim 1, wherein a spring element through which a pivot of the first part passes, is provided to produce the restoring force.

4. The rotary actuator according to claim 1, wherein the detent element engages positively in a detent receptacle of the control surface.

5. The rotary actuator according to claim 1, wherein the first part is a cam disk.

6. The rotary actuator according to claim 1, wherein the second part further comprises three detent elements, offset by 120 degrees.

7. The rotary actuator according to claim 1, wherein the actuator further comprises a rotatable third part, the recess having the first and second wall surfaces is provided in the third part, a rotational force is transmitted between the first and third parts via the peg of the first part engaging in the recess of the third part, there is rotational play between the first and third parts when the peg is partially disengaged from the recess.

8. The rotary actuator according to claim 7, wherein a spring element through which a pivot of the first part passes, is provided to produce the restoring force.

9. The rotary actuator according to claim 8, wherein the detent element engages positively in a detent receptacle of the control surface.

10. The rotary actuator according to claim 9, wherein the first part is a cam disk.

* * * * *